US007010832B2

(12) United States Patent
Chen

(10) Patent No.: US 7,010,832 B2
(45) Date of Patent: Mar. 14, 2006

(54) ANGULAR ADJUSTMENT ARRANGEMENT OF SIDE PIVOT HINGE

(76) Inventor: Mei Li Chen, 316 W. Naomi Ave., Arcadia, CA (US) 91007

( * ) Notice: Subject to any disclaimer, the term of this patent is extended or adjusted under 35 U.S.C. 154(b) by 95 days.

(21) Appl. No.: 10/678,147

(22) Filed: Oct. 2, 2003

(65) Prior Publication Data

US 2005/0071952 A1 Apr. 7, 2005

(51) Int. Cl.
*E05D 5/02* (2006.01)

(52) U.S. Cl. ..... 16/252; 16/235; 16/240; 16/332

(58) Field of Classification Search ..... 16/252, 16/257, 270, 235, 239–241, 321, 332, 334, 16/342; 403/289, 290; 4/607, 614, 557
See application file for complete search history.

(56) References Cited

U.S. PATENT DOCUMENTS 5,632,066 A * 5/1997 Huong ..... 16/338
5,867,869 A * 2/1999 Garrett et al. ..... 16/252
6,070,294 A * 6/2000 Perkins et al. ..... 16/252
6,085,388 A * 7/2000 Kaneko ..... 16/338
6,481,055 B1 * 11/2002 Cheng ..... 16/252
6,618,901 B1 * 9/2003 Wang-Lee ..... 16/228
6,704,966 B1 * 3/2004 Kao ..... 16/252
6,766,561 B1 * 7/2004 Cheng ..... 16/235

* cited by examiner

*Primary Examiner*—Chuck Y. Mah
*Assistant Examiner*—Michael J. Kyle
(74) *Attorney, Agent, or Firm*—Raymond Y. Chan; David & Raymond

(57) ABSTRACT

A side pivot hinge includes a joint body for securely mounting a side edge portion of the glass structure, a joint seat, having a joint sleeve, for securely mounting to a border frame, and an angular adjustment arrangement which includes a joint housing securely mounted to the joint body, a supporting shaft rotatably supported by the joint housing to rotatably insert into the joint sleeve to pivotally connect the joint body with the joint seat, and an angular adjustment locker to securely lock up the supporting shaft within the joint housing such that when the joint body is angularly moved with the joint seat for adjustably aligning the glass structure with the border frame, the supporting shaft is locked up at the joint housing in a rotatably movable manner via the angular adjustment locker for retaining an alignment of the glass structure in position with the border frame.

13 Claims, 5 Drawing Sheets

ANGULAR ADJUSTMENT ARRANGEMENT OF SIDE PIVOT HINGE

BACKGROUND OF THE PRESENT INVENTION

1. Field of Invention

The present invention relates to a pivot hinge assembly for a glass structure, and more particularly to an angular adjustment arrangement of a side pivot hinge for a glass structure, wherein the angular adjustment arrangement is adapted to selectively adjust an angular position of the glass structure so as to finely align the glass structure with the border frame.

2. Description of Related Arts

A side pivot hinge assembly normally used for pivotally mounting a glass door to a door frame, wherein the side pivot hinge assembly comprises two side pivot hinges pivotally and spacedly mounted on a side edge of the glass door to the door frame such that the glass door is adapted to pivotally mount to the door frame. However, such side pivot hinge assembly has several drawbacks.

The side pivot hinge generally comprises two cover walls to securely sandwich a side edge portion of the glass door and a pivot joint rotatably mounted between the cover walls to securely affix to the door frame such that the glass door is pivotally mounted within the door frame via the side pivot hinges. However, in order to adjustably align the glass door with respect to the door frame, the glass door must be unlocked from the cover walls of each of the pivot hinges such that the glass door can be angularly moved to fittingly align with the door frame. It is worth to mention that when the glass door is misalignedly mounted to the door frame, the ornamental appearance of the glass door will be destroyed or even the glass door cannot be closed. In other words, the configuration of the glass door is too complicated that a skilled technician is required for the installation.

In addition, the relatively heavy weight of the glass door and the pivot movement thereof will cause the glass door to misalign with the door frame after a period of time. However, the user is not able to self adjust the alignment of the glass door. Therefore, the user must call the technician to fix the alignment of the glass door which will highly increase the maintenance cost of the glass door.

SUMMARY OF THE PRESENT INVENTION

A main object of the present invention is to provide a side pivot hinge for a glass structure, wherein the side pivot hinge comprises an angular adjustment arrangement is adapted to selectively adjust an angular position of the glass structure so as to finely align the glass structure with the border frame.

Another object of the present invention is to provide a side pivot hinge for a glass structure, the glass structure does not require to be unlocked or released from the angular adjustment arrangement in order to align with the border frame. In other words, the aligning operation is easy and simple that an individual is able to self-adjust the glass structure to align with the border frame, so as to minimize the maintenance cost of the glass structure.

Another object of the present invention is to provide a side pivot hinge for a glass structure, wherein no expensive or complicated structure is required to employ in the present invention in order to achieve the above mentioned objects. Therefore, the present invention successfully provides an economic and effective solution not only for providing a rigid configuration to securely mount the glass structure within the border frame but also for enhancing the angular adjustment of the glass structure to align with the border frame.

Accordingly, in order to accomplish the above objects, the present invention provides a side pivot hinge for pivotally mounting a side edge portion of a glass structure to a border frame, wherein the side pivot hinge comprises:

a joint body comprising two spaced apart glass holding walls defining a securing cavity therebetween for securely sandwiching the side edge portion of the glass structure between the glass holding walls;

a joint seat, having a joint sleeve, adapted for securely mounting to the border frame; and an angular adjustment arrangement, comprising:

a joint housing securely mounted between the glass holding walls within the securing cavity;

a supporting shaft rotatably supported by the joint housing within the securing cavity, wherein the supporting shaft is rotatably inserted into the joint sleeve to pivotally connect the joint body with the joint seat for pivotally mounting the glass structure to the border frame; and an angular adjustment locker provided at an outer side of the joint body to securely lock up the supporting shaft within the joint housing in a rotatably movable manner such that when the joint body is angularly moved with respect to the joint seat for adjustably aligning the glass structure with respect to the border frame, the supporting shaft is locked up at the joint housing in a rotatably movable manner via the angular adjustment locker for retaining an alignment of the glass structure in position with respect to the border frame.

These and other objectives, features, and advantages of the present invention will become apparent from the following detailed description, the accompanying drawings, and the appended claims.

DETAILED DESCRIPTION OF THE PREFERRED EMBODIMENT

Figure 1:
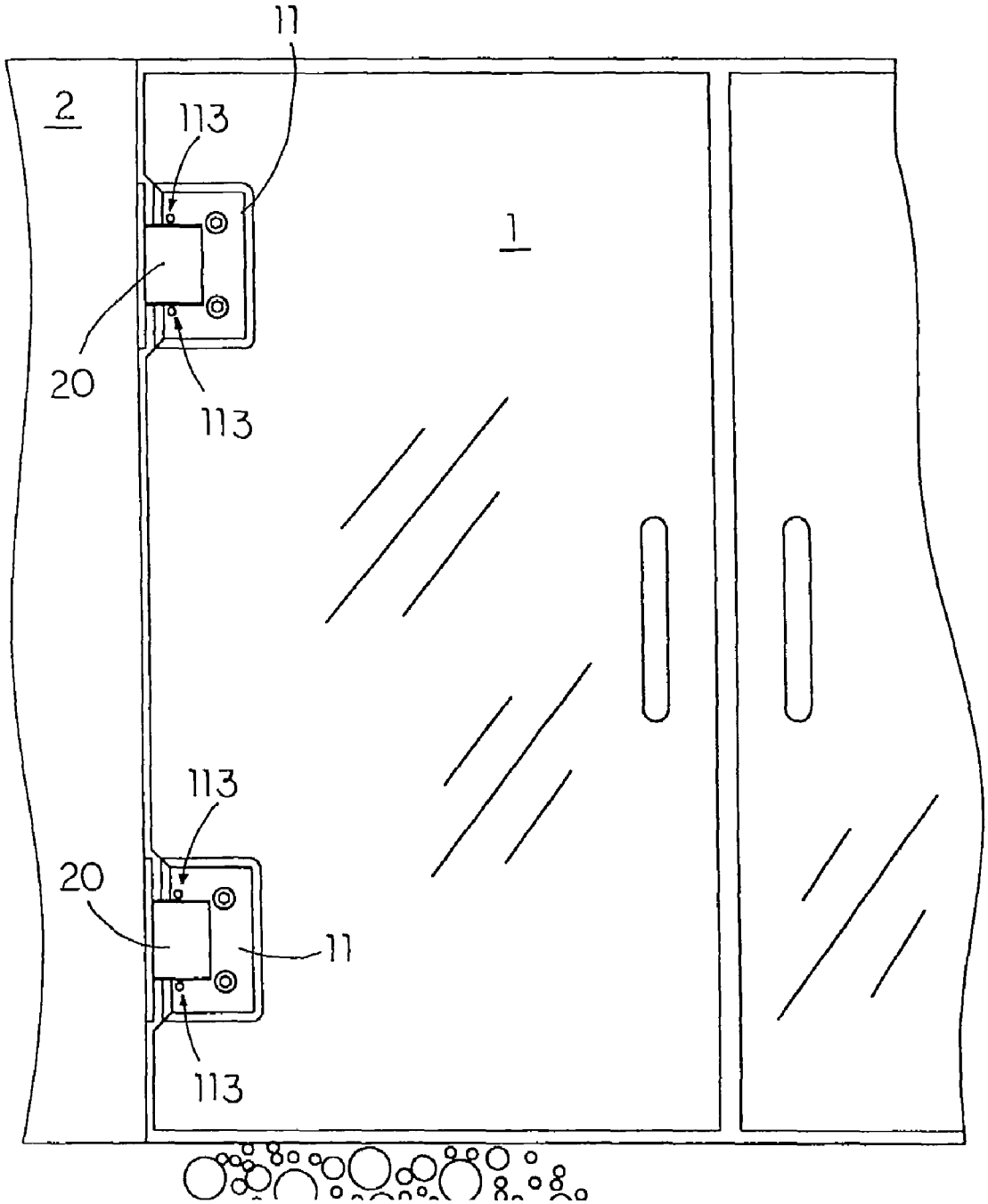
FIG. 1 is a front view of a side pivot hinge for pivotally mounting a glass structure to a border frame according to a preferred embodiment of the present invention.
Figure 2:
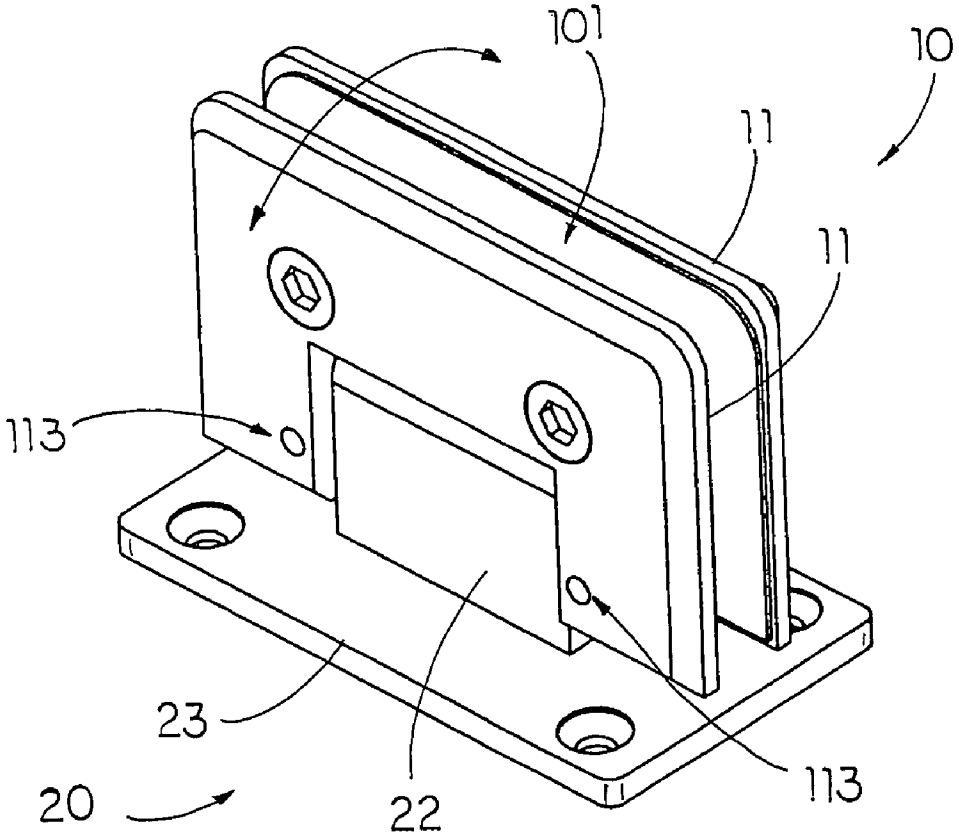
FIG. 2 is a perspective view of the side pivot hinge according to the above preferred embodiment of the present invention.
Figure 3:
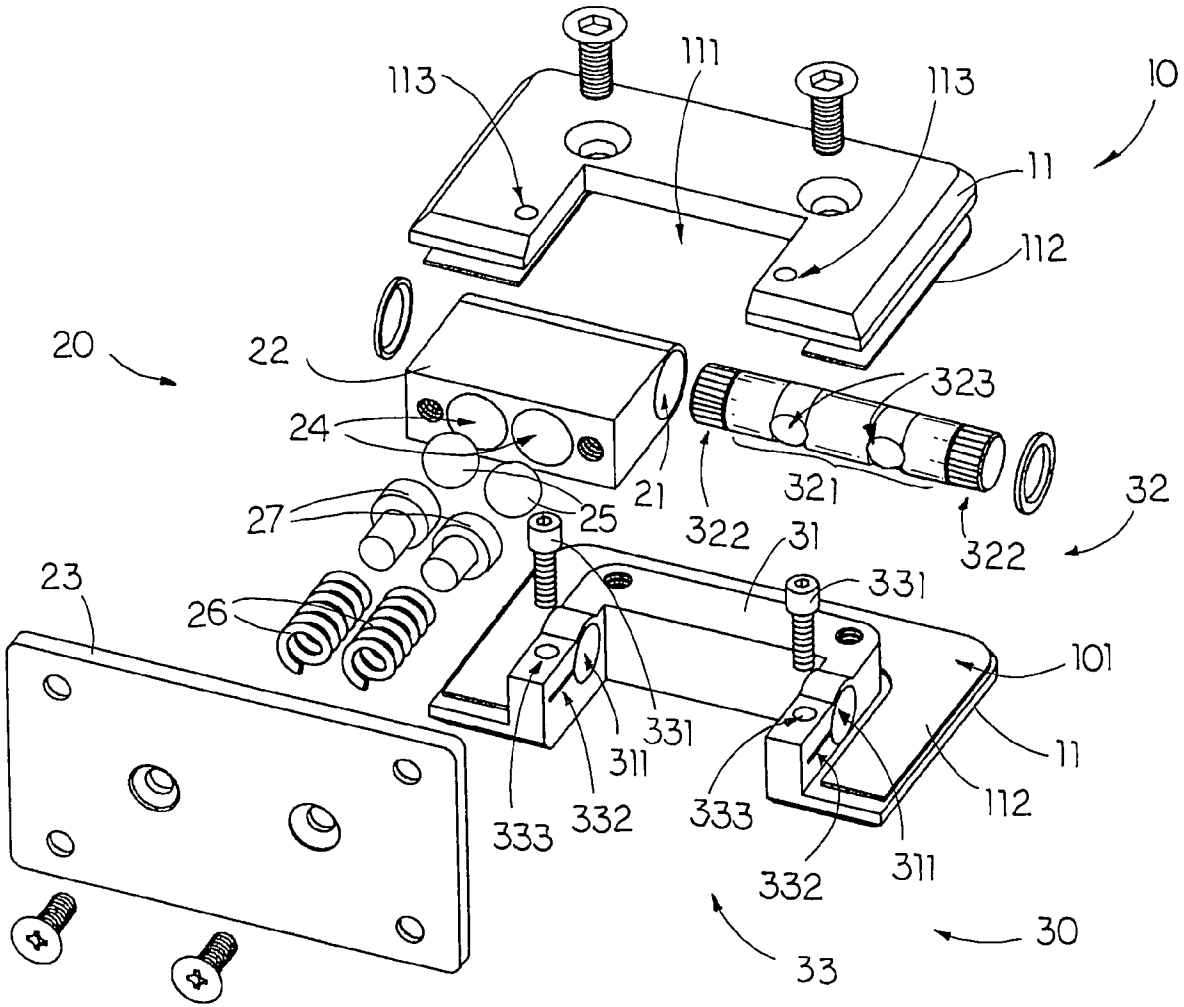
FIG. 3 is an exploded perspective view of the side pivot hinge according to the above preferred embodiment of the present invention.
Figure 4:
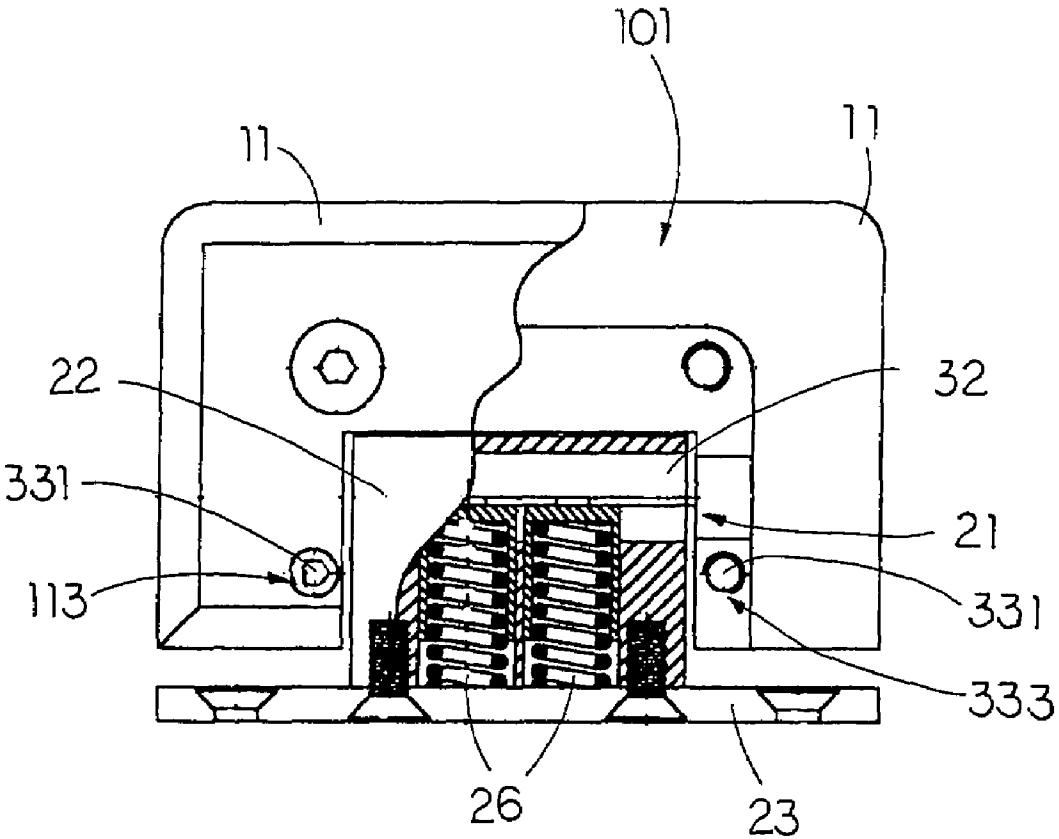
FIG. 4 is a front sectional view of the side pivot hinge according to the above preferred embodiment of the present invention.
Figure 5:
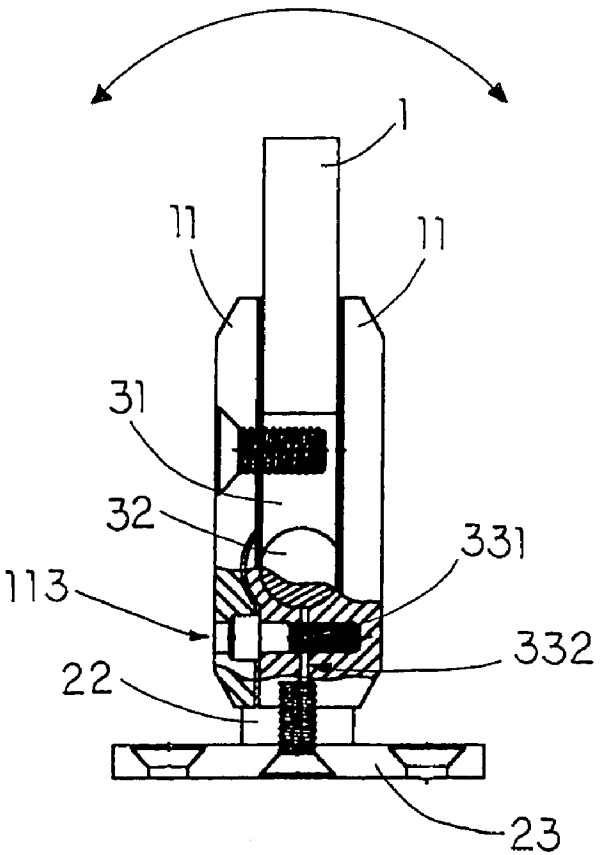
FIG. 5 is a side sectional view of the side pivot hinge according to the above preferred embodiment of the present invention.

Referring to FIGS. 1 to 3 of the drawings, a side pivot hinge according to a preferred embodiment of the present invention is illustrated, wherein the side pivot hinge is arranged to pivotally mount a side edge portion of a glass structure 1 to a border frame 2.

As shown in FIG. 1, the glass structure 1 is embodied as a glass door pivotally mounted to a door frame as the border frame 2 via the side pivot hinge of the present invention. It is worth to mention that the glass structure 1 can be a glass window pivotally mounted to a window frame as the border frame 2.

The side pivot hinge comprises a joint body 10 for mounting on the glass structure 1, and a joint seat 20, having a joint sleeve 21, adapted for securely mounting to the border frame 2.

The joint body 10 comprises two spaced apart glass holding walls 11 defining a securing cavity 101 therebetween for securely sandwiching the side edge portion of the glass structure 1 between the glass holding walls 11.

The side pivot hinge further comprises an angular adjustment arrangement 30 which comprises a joint housing 31 securely mounted between the glass holding walls 11 within the securing cavity 101, a supporting shaft 32 rotatably supported by the joint housing 31, and an angular adjustment locker 33.

The supporting shaft 32 is rotatably supported by the joint housing 31 within the securing cavity 101, wherein the supporting shaft 32 is rotatably inserted into the joint sleeve 21 to pivotally connect the joint body 10 with the joint seat 20 for pivotally mounting the glass structure 1 to the border frame 2.

The angular adjustment locker 33 is provided at an outer side of the joint body 10 to securely lock up the supporting shaft 32 within the joint housing 31 in a rotatably movable manner such that when the joint body 10 is angularly moved with respect to the joint seat 20 for adjustably aligning the glass structure 1 with respect to the border frame 2, the supporting shaft 32 is locked up at the joint housing 31 in a rotatably movable manner via the angular adjustment locker 33 for retaining an alignment of the glass structure 1 in position with respect to the border frame 2.

According to the preferred embodiment, the joint body 10 is adapted for securely mounting at the side edge portion of the glass structure 1 by sandwiching the side edge portion of the glass structure 1 between the glass holding walls 11. Each of the glass holding walls 11, having a U-shaped, defines an accessing cavity 111 to communicate with the joint seat 20. Each of the glass holding walls 11 further comprises a cushion layer 112 attached to an inner side thereof for frictionally contacting with the glass structure 1 so as to not only substantially hold the glass structure 1 within the securing cavity 101 but also prevent the glass from being scratched when the glass holding walls 11 press thereon.

The joint seat 20 is mounted at the border frame 2 as the pivot hinge such that when the joint body 10 is pivotally engaged with the joint seat 20 through the supporting shaft 32, the glass structure 1 is pivotally mounted within the border frame 2.

The joint seat 20, having a T-shaped, comprises a side mounting platform 23 adapted for securely attaching to the border frame 2 and a joint base 22 extended from the side mounting platform 23 to dispose within the accessing cavity 111, wherein the joint sleeve 21 is transversely formed on the joint base 22 to rotatably engage the supporting shaft 32 so as to pivotally connect the joint seat 20 with the joint body 10. It is worth to mention that the glass holding walls 11 are configured to have a U-shape to reduce the overall weight of the joint body 10 and the size of the side pivot hinge so as to minimize the manufacturing cost of the side pivot hinge and to prevent the glass structure 1 from being misaligned with the border frame 2 due to the weight of the joint body 10.

As shown in FIG. 3, a length of the joint sleeve 21 is shorter than a length of the supporting shaft 32 in such a manner that a central portion 321 of the supporting shaft 32 is rotatably received within the joint sleeve 21 while two end portions 322 of the supporting shaft 32 are coaxially extended from two ends of the joint sleeve 21 respectively.

The joint seat 20 further has at least a control slot 24 radially extended to communicate with the joint sleeve 21 and comprises at least a driving member 25 rotatably disposed within the control slot 24 to bias against the supporting shaft 32 so as to ensure a rotational movement of the supporting shaft 32 within the joint sleeve 21.

Accordingly, the driving member 25 is a ball shaped bearing member rotatably disposed within the control slot 24 to contact with the supporting shaft 32 so as to ensure the rotational movement of the supporting shaft 32 within the axial sleeve 211 by reducing the friction therebetween.

The joint seat 20 further comprises at least a resilient member 26 disposed within the control slot 24 for applying an urging pressure against the driving member 25 to bias against the supporting shaft 32. The resilient members 26 is a compression spring having two ends biasing against the driving member 25 and the side mounting platform 23 to push the driving member 25 towards the supporting shaft 32. In addition, at least a driving holder 27 is mounted between the resilient member 26 and the driving member 25 to hold the driving member 25 in position within the control slot 25.

As shown in FIG. 3, the joint housing 31, which is integrally extended from one of the glass holding walls 11 within the securing cavity 101, has two locking slots 311 coaxially aligned with the joint sleeve 21 of the joint seat 20 at two ends thereof respectively. In other words, when the joint seat 20 is disposed within the accessing cavity 111 of the joint body 10, the two locking slots 311 of the joint housing 31 are coaxially aligned with two ends of the joint sleeve 21 respectively so as to communicate the locking slots 311 with the joint sleeve 21.

Accordingly, when the central portion 321 of the supporting shaft 32 is rotatably received in the joint sleeve 21 of the joint seat 20, the two end portions 322 of the supporting shaft 32 are rotatably engaged with the locking slots 311 of the joint housing 31 respectively to pivotally mount the joint seat 20 with the joint body 10.

The supporting shaft 32 further has at least a guiding indention 323 longitudinally formed on the central portion 321 wherein the driving member 25 is arranged to bias against the central portion 321 of the supporting shaft 32 at the guiding indention 323 for alignedly retaining the glass structure 1 in a closed position with respect to the border frame 2. In other words, the guiding indention 323 of the supporting shaft 32 functions as guider to retain the glass structure 1 to align with the border frame 2 when the driving member 25 biases against the central portion 321 of the supporting shaft 32 at the guiding indention 323.

It is worth to mention that the glass structure 1 is arranged to pivotally mount with the border frame 2 between the closed position and an opened position, i.e. closing the door and opening the door respectively. In order to retain the glass structure 1 at the closed position, the resilient element 26 applies an urging force against the driving member 25 to bias against the central portion 321 of the supporting shaft 32 at the guiding indention 323 so as to retain the rotational movement of the supporting shaft 32 within the joint sleeve 21.

The angular adjustment locker 33 comprises two locking members 331 and has two adjustment slits 332 longitudinally formed on the joint housing 31 to respectively communicate with the locking slots 311 and two locking holes 333 transversely formed on the outer side of the joint housing 31 though the adjustment slits 332 respectively, wherein each of the locking members 331 is rotatably engaged with the respective locking hole 333 to adjustably reduce a width of the respective adjustment slit 332 so as to lock up the end portions 322 of the supporting shaft 32 within the locking slots 311 respectively.

Each of the adjustment slit 332 is longitudinally formed along the joint housing 31 to across the respective locking slot 311 and each of the locking holes 333 is transversely formed on the outer side of the joint housing 31 through the respective adjustment slit 332 such that a size of each of the locking slots 311 is substantially reduce to frictionally lock up the respective end portion 322 of the supporting shaft 32 within the locking slot 311 when the locking member 331 is rotatably engaged with the locking hole 333 to reduce the width of the adjustment slit 332.

In other words, a width of each of the locking slots 311 is arranged to be adjustably reduced via the respective locking member 331 such that an inner circumferential surface of the locking slot 311 is frictionally biased against an circumferential surface of the end portion 322 of the supporting shaft 32 so as to securely lock up the end portions 322 of the supporting shaft 32 within the locking slots 311 respectively. Preferably, each of the end portions 322 of the supporting shaft 32 is constructed to have a cog-liked cross section to frictionally engage with an inner wall of the respective locking slot 311, so as to ensure the supporting shaft 32 locking up with the joint housing 31. It is worth to mention that when the end portions 322 of the supporting shaft 32 are locked up with the joint housing 31 via the angular adjustment locker 30, the supporting shaft 32 can only be rotated with respect to the joint body 10 within the joint sleeve 21 of the joint seat 20.

Therefore, after the glass structure 1 is pivotally installed to the border frame 2 via the side pivot hinge of the present invention, the glass structure 1 is adapted to finely adjust the alignment of the glass structure 1 with respect to the border frame 2 by rotating the two end portions 322 of the supporting shaft 32 within the locking slots 311 respectively. Once the glass structure 1 is aligned with the border frame 2, the joint housing 31 is arranged to lock up the two end portions 322 of the supporting shaft 32 within the locking slots 311 respectively via the angular adjustment locker 30, so as to lock up the aligned position of the glass structure 1 with respect to the border frame 2.

As shown in FIG. 3, one of the glass holding walls 11 further has two operation slots 113 respectively align with the locking holes 333 to communicate with the two locking members 331 for operating the locking members 331 in a rotatably movable manner so as to adjustably reduce the widths of the adjustment slits 332 through the operation slots 113 respectively.

Since the joint housing 31 is sandwiched between the two glass holding walls 11 to securely mount in the joint body 10, the two operation slots 113 allow the user to operate the angular adjustment locker 33 without disassembling the joint body 10. In other words, after mounting the glass structure 1 to the border frame 2 via the side pivot hinge of the present invention, the user is able to use a tool for performing the locking and unlocking operations of the angular adjustment locker 33 through the operation slots 113 so as to adjust the alignment of the glass structure 1 with respect to the border frame 2 without detaching the joint body 1 from the glass structure 1.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A side pivot hinge for pivotally mounting a side edge portion of a glass structure to a border frame, wherein said side pivot hinge comprises:

a joint body comprising two spaced apart glass holding walls defining a securing cavity therebetween for securely sandwiching said side edge portion of said glass structure between said glass holding walls;

a joint seat, having a joint sleeve, adapted for securely mounting to said border frame; and an angular adjustment arrangement, comprising:

a joint housing securely mounted between said glass holding walls within said securing cavity;

a supporting shaft rotatably supported by said joint housing within said securing cavity, wherein said supporting shaft is rotatably inserted into said joint sleeve to pivotally connect said joint body with said joint seat for pivotally mounting said glass structure to said border frame; and an angular adjustment locker provided at an outer side of said joint body to securely lock up said supporting shaft within said joint housing in a rotatably movable manner such that when said joint body is angularly moved with respect to said joint seat for adjustably aligning said glass structure with respect to said border frame, said supporting shaft is locked up at said joint housing in a rotatably movable manner via said angular adjustment locker for retaining an alignment of said glass structure in position with respect to said border frame, wherein said supporting shaft has a central portion rotatably received in said joint sleeve of said joint seat and two end portions rotatably engaged with said joint housing such that said two end portions of said supporting shaft are locked up at said joint housing via said angular adjustment locker for retaining said alignment of said glass structure in position with respect to said border frame, wherein said joint housing has two locking slots coaxially aligned with said joint sleeve of said joint seat at two ends thereof respectively to rotatably receive said two end portions of said supporting shaft so as to pivotally connect said joint seat with said joint body, wherein said two end portions of said supporting shaft are respectively locked up at said two locking slots via said angular adjustment locker for retaining said alignment of said glass structure in position with respect to said border frame, wherein said angular adjustment locker comprises two locking members and has two adjustment slits longitudinally formed on said joint housing to respectively communicate with said locking slots and two locking holes transversely formed on an outer side of said joint housing though said adjustment slits respectively, wherein each of said locking members is rotatably engaged with said respective locking hole to adjustably reduce a width of said respective adjustment slit so as to lock up said end portions of said supporting shaft within said locking slots respectively.

2. The side pivot hinge, as recited in claim 1, wherein each of said end portions of said supporting shaft is frictionally engaged with an inner wall of said respective locking slot, so as to ensure said supporting shaft to lock up with said joint housing.

3. The side pivot hinge, as recited in claim 1, wherein one of said glass holding walls has two operation slots respectively align with said locking holes to communicate with said locking members for operating said locking members in a rotatably movable manner so as to adjustably reduce said widths of said adjustment slits through said operation slots respectively.

4. The side pivot hinge, as recited in claim 2, wherein one of said glass holding walls has two operation slots respectively align with said locking holes to communicate with said locking members for operating said locking members in a rotatably movable manner so as to adjustably reduce said widths of said adjustment slits through said operation slots respectively.

5. The side pivot hinge, as recited in claim 1, wherein said joint seat further has at least a control slot radially extended to communicate with said joint sleeve and comprises at least a driving member rotatably disposed with said control slot to bias against said central portion of said supporting shaft so as to ensure a rotational movement of said supporting shaft within said joint sleeve.

6. The side pivot hinge, as recited in claim 2, wherein said joint seat further has at least a control slot radially extended to communicate with said joint sleeve and comprises at least a driving member rotatably disposed with said control slot to bias against said central portion of said supporting shaft so as to ensure a rotational movement of said supporting shaft within said joint sleeve.

7. The side pivot hinge, as recited in claim 4, wherein said joint seat further has at least a control slot radially extended to communicate with said joint sleeve and comprises at least a driving member rotatably disposed with said control slot to bias against said central portion of said supporting shaft so as to ensure a rotational movement of said supporting shaft within said joint sleeve.

8. The side pivot hinge, as recited in claim 5, wherein said supporting shaft further has a guiding indention longitudinally formed on said central portion, wherein said driving member is arranged to bias against said central portion of said supporting shaft at said guiding indention for aligned retaining said glass structure with respect to said border frame.

9. The side pivot hinge, as recited in claim 6, wherein said supporting shaft further has a guiding indention longitudinally formed on said central portion, wherein said driving member is arranged to bias against said central portion of said supporting shaft at said guiding indention for aligned retaining said glass structure with respect to said border frame.

10. The side pivot hinge, as recited in claim 7, wherein said supporting shaft further has a guiding indention longitudinally formed on said central portion, wherein said driving member is arranged to bias against said central portion of said supporting shaft at said guiding indention for aligned retaining said glass structure with respect to said border frame.

11. The side pivot hinge, as recited in claim 2, wherein each of said glass holding walls, having a U-shaped, defines an accessing cavity to communicate with said joint seat, wherein said joint seat, having a T-shaped, comprises a side mounting platform for securely attaching to said border frame and a joint base extended from said side mounting platform to dispose within said accessing cavity, wherein said joint sleeve is transversely formed on said joint base to rotatably engage said supporting shaft so as to pivotally connect said joint seat with said joint body.

12. The side pivot hinge, as recited in claim 4, wherein each of said glass holding walls, having a U-shaped, defines an accessing cavity to communicate with said joint seat, wherein said joint seat, having a T-shaped, comprises a side mounting platform for securely attaching to said border frame and a joint base extended from said side mounting platform to dispose within said accessing cavity, wherein said joint sleeve is transversely formed on said joint base to rotatably engage said supporting shaft so as to pivotally connect said joint seat with said joint body.

13. The side pivot hinge, as recited in claim 10, wherein each of said glass holding walls, having a U-shaped, defines an accessing cavity to communicate with said joint seat, wherein said joint seat, having a T-shaped, comprises a side mounting platform for securely attaching to said border frame and a joint base extended from said side mounting platform to dispose within said accessing cavity, wherein said joint sleeve is transversely formed on said joint base to rotatably engage said supporting shaft so as to pivotally connect said joint seat with said joint body.

* * * * *